US010112767B2

(12) United States Patent
Neuhalfen et al.

(10) Patent No.: US 10,112,767 B2
(45) Date of Patent: Oct. 30, 2018

(54) FAN SPRAY STRUCTURE FOR USE IN DISPENSING ACTUATOR

(75) Inventors: Mark G. Neuhalfen, Mount Prospect, IL (US); Peter J. Walters, Barrington, IL (US)

(73) Assignee: APTARGROUP, INC., Crystal Lake, IL (US)

( * ) Notice: Subject to any disclaimer, the term of this patent is extended or adjusted under 35 U.S.C. 154(b) by 731 days.

(21) Appl. No.: 14/241,110

(22) PCT Filed: Oct. 12, 2011

(86) PCT No.: PCT/US2011/055909

§ 371 (c)(1),
(2), (4) Date: Feb. 26, 2014

(87) PCT Pub. No.: WO2013/055323

PCT Pub. Date: Apr. 18, 2013

(65) Prior Publication Data

US 2014/0367490 A1 Dec. 18, 2014

(51) Int. Cl.

| | |
|---|---|
| ***B65D 83/20*** | (2006.01) |
| ***B05B 1/04*** | (2006.01) |
| ***B65D 83/28*** | (2006.01) |

(52) U.S. Cl.

CPC ..... *B65D 83/205* (2013.01); *B05B 1/042* (2013.01); *B05B 1/048* (2013.01); *B65D 83/206* (2013.01); *B65D 83/28* (2013.01)

(58) Field of Classification Search

CPC ..... F02M 47/027; F02M 57/02

(Continued)

(56) References Cited

U.S. PATENT DOCUMENTS

| | | | |
|---|---|---|---|
| 3,519,210 | A | 7/1970 | Plain |
| 3,652,018 | A | 3/1972 | Focht |

(Continued)

FOREIGN PATENT DOCUMENTS

| | | | |
|---|---|---|---|
| GB | 732473 | | 6/1955 |
| GB | 2244013 | A | 11/1991 |
| WO | 2008008588 | A2 | 1/2008 |

OTHER PUBLICATIONS

The "International Search Report and Written Opinion of the International Searching Authority, or the Declaration" dated "Mar. 5, 2012" for the International Application No. PCT/US2011/055909 of which the above-captioned instant U.S. patent application Serial No. (not yet designated) is a U.S. national phase application.

*Primary Examiner* — Alexander Valvis
*Assistant Examiner* — Christopher R Dandridge
(74) *Attorney, Agent, or Firm* — Wood, Phillips, Katz, Clark & Mortimer

(57) ABSTRACT

An improvement is provided in an actuator for actuating a valve on a container for dispensing a fluent product from the container in a fan spray pattern. The actuator includes a dispensing flow path to direct fluent product from the valve to an exterior of the actuator via an exit orifice located at an end of the flow path, and a post defining a portion of the flow path, the post extending along and centered on a longitudinal axis and having an end face adjacent said exit orifice. The improvement includes a flow channel extending laterally across the end face of the post, the flow channel being symmetric about a lateral axis extending transverse to the longitudinal axis of the post, a portion of the flow channel directly communicating with said exit orifice to direct the fluent product from the flow channel into the exit orifice.

17 Claims, 10 Drawing Sheets

(58) Field of Classification Search
USPC ... 239/88, 96, 525, 527, 333, 349, 350, 354, 239/337; 222/324, 383.1, 384, 385
See application file for complete search history.

(56) References Cited

U.S. PATENT DOCUMENTS

| | | | | |
|---|---|---|---|---|
| 3,942,725 | A | 3/1976 | Green | |
| 4,036,439 | A | 7/1977 | Green | |
| 4,182,496 | A | 1/1980 | Burke | |
| 4,401,271 | A | 8/1983 | Hansen | |
| 4,401,272 | A | 8/1983 | Merton et al. | |
| 4,503,998 | A * | 3/1985 | Martin | B05B 11/00 222/341 |
| 4,603,813 | A | 8/1986 | Luegering | |
| 5,890,661 | A | 4/1999 | Crampton et al. | |
| 6,254,015 | B1 | 7/2001 | Abplanalp | |
| 6,345,775 | B1 * | 2/2002 | Purvis, II | B65D 83/303 239/333 |
| 2007/0090208 | A1 | 4/2007 | Geskin et al. | |
| 2009/0078793 | A1 | 3/2009 | Nelson et al. | |

* cited by examiner

FAN SPRAY STRUCTURE FOR USE IN DISPENSING ACTUATOR

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

TECHNICAL FIELD

The present invention relates generally to hand-held dispensing packages for dispensing fluent material, typically a spray or foam, from a container, which can be pressurized or non-pressurized. A finger-operable actuator is used in such dispensing packages to dispense the fluent product from the container. The invention more particularly relates to dispensing packages having an actuator that provides a fan-shaped pattern of a fluent material as it is dispensed from the actuator.

BACKGROUND OF THE INVENTION AND TECHNICAL PROBLEMS POSED BY THE PRIOR ART

Finger-operable actuators are typically adapted to be incorporated in dispensing systems mounted on hand-held containers that are commonly used for fluent products. Some actuators are designed for use with a valve assembly and have a suitable discharge structure to produce a foam, mousse, or atomized spray. A dispensing system comprising such a valve assembly and cooperating actuator is typically used for dispensing household products, such as cleaning products, deodorizers, insecticide; and other fluent products, such as cosmetic products or other personal care products such as shaving cream or shaving foam, hair mousse, sun care products, etc., as well as other institutional and industrial products.

Dispensing systems comprising a valve assembly and cooperating actuator are typically mounted at the top of the container, such as a metal can containing a pressurized product. The container, the product and any propellant in the container, the valve assembly, and the actuator all together make up a dispensing package. The actuator typically includes a component that is connected to the valve assembly external of the container and that provides a dispensing flow path or passage from the valve assembly and through which the product can be dispensed to a target area.

For some types of fluent products, the dispensing system may be provided with structure in the actuator to provide a fan-shaped spray pattern of the fluent product as it is dispensed from the actuator. As used herein, and in the industry, the term "fan-shaped spray" means any oval or otherwise elongate spray pattern having a major axis that is greater than a minor axis when the spray pattern is taken normal to the direction of flow from the dispensing system. In current systems, this structure is provided in the form of a nozzle insert having special configurations in the orifice or orifices of the insert that provide the fan spray pattern and which require specific orientation during assembly of the nozzle insert into the actuator in order to ensure that the fan spray pattern has the desired orientation with respect to the dispensing package. U.S. Patent Publication No. 2007/0090208 A1 shows some examples of such nozzle inserts. While such structures may work well for their intended purpose, the requirement for a specific orientation between the insert and the remainder of the actuator complicates the assembly and will typically require that the actuator have specific structure formed within it so as to ensure the proper orientation.

SUMMARY OF THE INVENTION

In accordance with one feature of the invention, an actuator is provided for actuating a valve on a container for dispensing a fluent product from the container. The actuator includes a dispensing flow path to direct fluent product from the valve to an exterior of the actuator via an exit orifice located at an end of the flow path, and a post defining a portion of the flow path. The post extends along and is centered on a longitudinal axis and has an end face adjacent the exit orifice. An improvement includes a flow channel extending laterally across the end face of the post, the flow channel being symmetric about a lateral axis extending transverse to the longitudinal axis of the post, and a portion of the flow channel directly communicating with the exit orifice to direct the fluent product from the flow channel into the exit orifice.

In one feature, the exit orifice is defined in an insert having an interior face overlying the end face of the post, an exterior face opposite from the interior face with the exit orifice extending from the interior face to the exterior face, and a laterally inwardly facing wall surface extending from the interior face and surrounding at least a portion of the post to define a portion of the flow path between the wall surface and a laterally outwardly facing side wall surface of the post.

As one feature, the exit orifice includes a frustoconical exit portion that diverges as it extends towards the exterior face of the insert.

In one feature, the orifice is centered on the longitudinal axis of the post, and the lateral axis of the flow channel intersects the longitudinal axis of the post.

According to one feature, the flow channel is defined by two spaced side surfaces, the spacing of each side surface from the lateral axis being equal to the spacing of the other side surface from the lateral axis as each side surface extends laterally across the end face of the post.

In one feature, the side surfaces extend parallel to each other and to the lateral axis.

As one feature, the spacing between the side surfaces varies across the face of the post.

According to one feature, the lateral axis of the flow channel intersects the longitudinal axis of the post, and the side surfaces are spaced farther from each other as they extend laterally outward from the longitudinal axis.

As one feature, the flow channel is symmetric about a transverse axis that intersects the longitudinal axis of the post and extends transverse to both the longitudinal axis and the lateral axis.

In one feature, portions of the side surfaces extend into the exit orifice.

According to one feature, the flow channel is further defined by a bottom surface extending from one of the side surfaces to the other of the side surfaces, the bottom surface defining a flow channel depth relative to the end face that varies as the flow channel extends laterally across the end face.

As one feature, the bottom surface defines an arcuate shaped profile at an intersection of the bottom surface with a plane extending parallel to both the longitudinal axis and the lateral axis.

In one feature, the bottom surface defines a v-shaped profile at an intersection of the bottom surface with a plane extending parallel to both the longitudinal axis and the lateral axis.

As one feature, a central portion of the bottom surface is planar and extends parallel to the lateral axis and defines a plane transverse to the longitudinal axis.

According to one feature, the post is defined by a cylindrical, laterally outwardly facing, side wall surface that is centered on the longitudinal axis and extends from the end face to a remainder of the actuator, and the end face is planar and extends transverse to the longitudinal axis.

Other objects, features, and advantages of the invention will become apparent from a review of the entire specification, including the appended claims and drawings.

DESCRIPTION OF THE PREFERRED EMBODIMENT

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention are described, along with the container and valve, in a typical (upright) position, and terms such as upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

As will be further described in detail, the present invention is directed to an improvement in actuators used in dispensing fluent material or product in a fan spray pattern from a container of a dispensing package, such as for dispensing pressurized fluent product in a fan spray pattern from the associated container.

Figure 1:
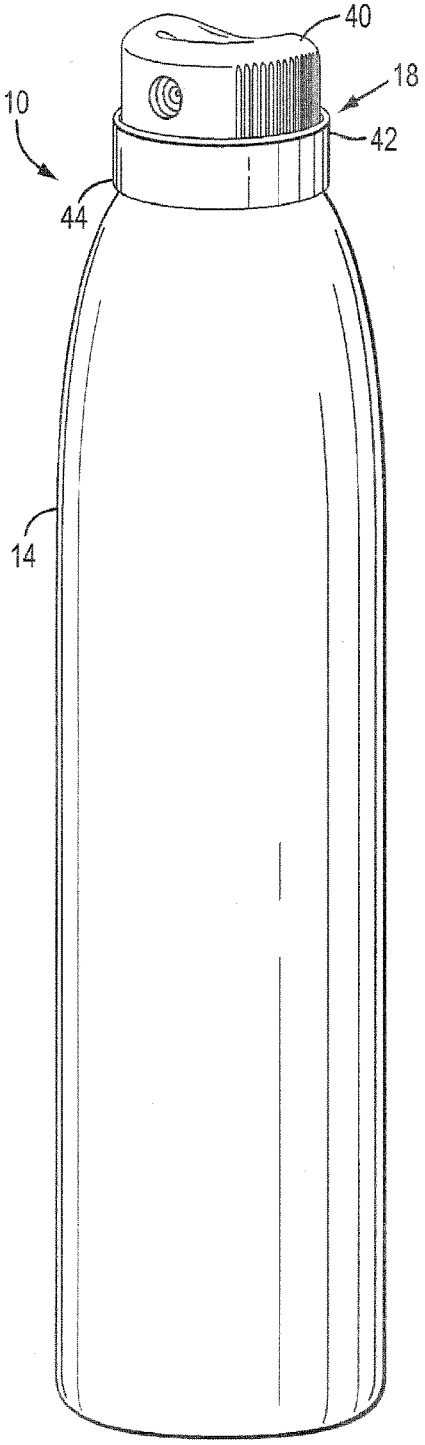
FIG. 1 is an isometric view from the front and above of a hand-held, finger-operable dispensing package that incorporates a dispensing system that includes a valve assembly (not visible in FIG. 1) and a cooperating finger-operable actuator installed on a container of pressurized product, the actuator providing a fan-shaped spray pattern according to the invention.
Figure 2:
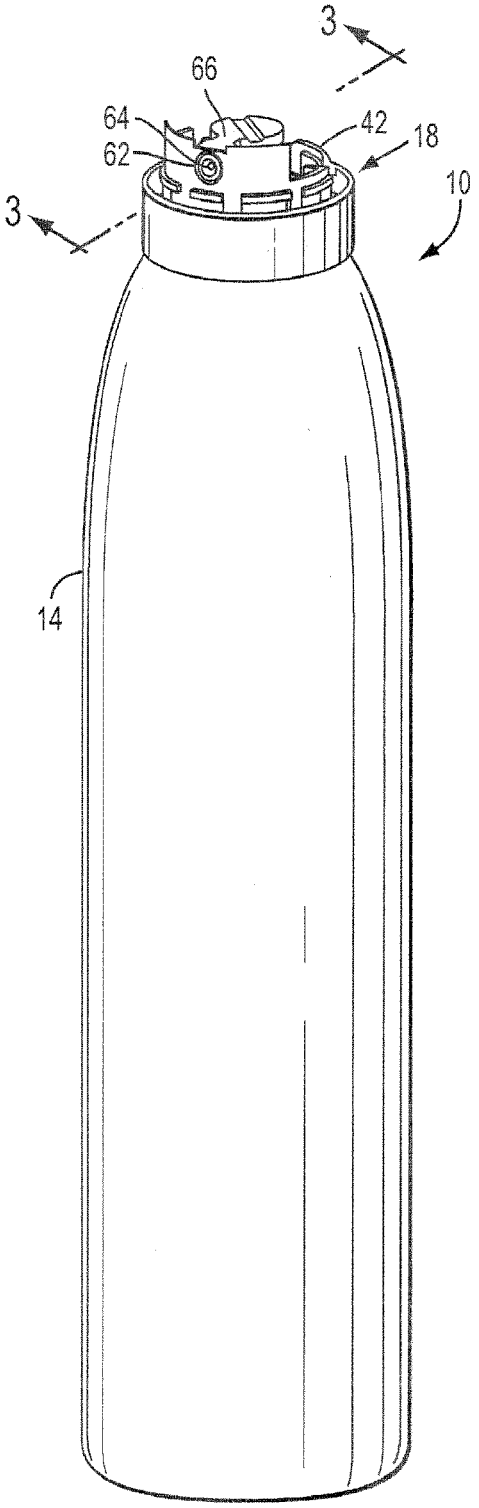
FIG. 2 is an isometric view similar to FIG. 1, but with a finger-engageable actuator button not shown so as to more clearly illustrate selected features of the actuator.
Figure 3:
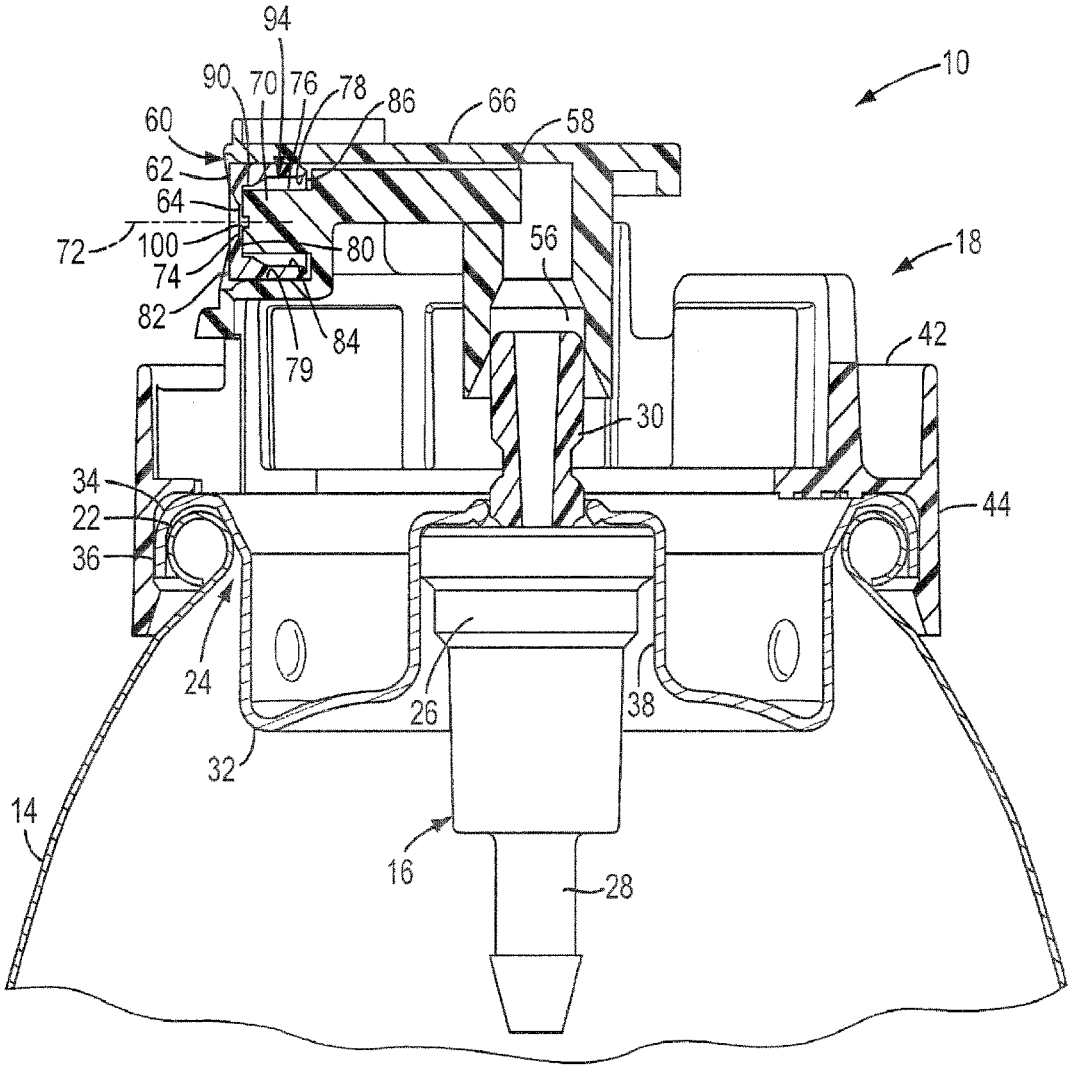
FIG. 3 is an enlarged, fragmentary, cross-sectional view taken along line 3-3 in FIG. 2, with a diagrammatic representation of a valve body of the dispensing system.

FIGS. 1-3 illustrate a hand-held dispensing package 10 including a pressurized container 14 containing a fluent product, a dispensing valve 16 (shown diagrammatically in FIG. 3) in the form of an aerosol dispensing valve or a bag-on-valve dispensing valve (bag not shown), and a finger-operable, actuator 18.

It should be understood that the container 14 and valve 16 can be of any conventional, known construction, and accordingly will only be briefly described herein. The container 14 is typically a metal can having an upper edge rolled into a mounting bead 22 surrounding a container opening 24, as best seen in FIG. 3. The container 14 is adapted to hold the fluent product (e.g., a liquid (not shown)) and pressurized gas (not shown) below the dispensing valve 16.

The dispensing valve 16 may be of any suitable conventional or special type. With reference to FIG. 3, the dispensing valve 16 will typically include a body 26 containing the working components of the valve 16, with the bottom end 28 of the body 26 being attached to a conventional dip tube (not shown) that directs the fluent product from the container 14 and into the body 26 to be dispensed from the container 14. The upper end of the body 26 is typically a valve stem 30 that projects above the top of the container 14 to be actuated from a closed position (FIG. 3) wherein fluent product is not dispensed through the valve 16 and to an open position wherein the fluent product is dispensed through the valve 16 via the valve stem 30. Typically, the valve stem 30 is biased to the closed position, such as by a spring (not visible) contained in the valve body 26, so that the valve 16 is normally closed unless forced to the open position by the actuator 18 as it is actuated by a user. After the dispensing valve 16 is actuated to dispense product as atomized spray or foam, the user terminates the actuation operation so that the valve stem 30 is returned by the spring (not visible) to the closed position condition wherein the valve 16 is closed.

The dispensing valve 16 is mounted to the container 14 by any suitable means. As shown in FIG. 3, one such suitable means is a conventional valve mounting cup 32 which has a mounting flange 34 with an outer peripheral portion 36 that can be crimped about the container mounting bead 22 to provide a secure and sealed attachment of the mounting cup 32 to the container 14 at the container opening 24.

The mounting cup 32 includes an annular inner wall 38 which defines an opening through which a portion of the valve body 26 projects, with a portion of the annular inner wall 38 crimped to the exterior of the valve body 26 to provide a secure and sealed attachment of the valve body 26 to the mounting cup 32.

U.S. Published Application Number 2008/0210710 A1, and U.S. Pat. Nos. 7,249,692 and 7,861,894 each show and describe in further detail other suitable forms of valves 16 that can be employed in connection with the present invention.

It will be appreciated that the particular type of the dispenser valve 16 may be of any suitable design for dispensing a product from the container 14 (with or without a dip tube) out through the valve stem 30. The detailed design and construction of the dispensing valve 16 per se forms no part of the present invention. It should further be understood that while the preferred embodiments of the actuator 18 are shown herein in connection with a dispensing valve 16, in some applications it may be desirable to utilize an actuator 18 according to the invention with other types of dispensing devices.

Figure 6:
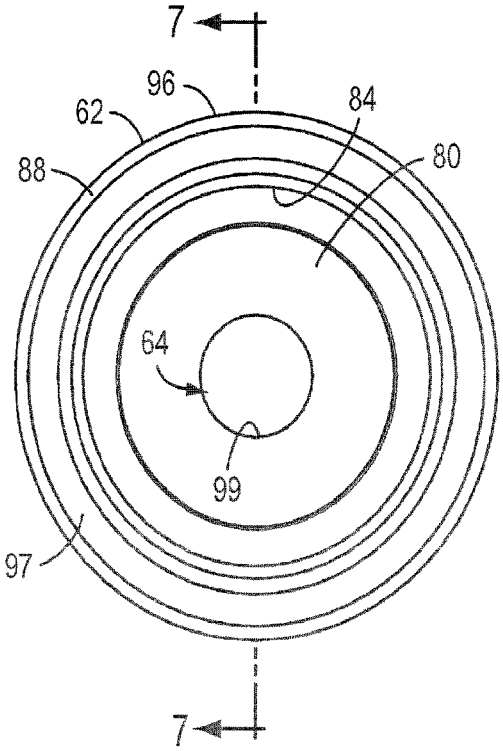
FIG. 6 is an enlarged rear view of the insert of FIGS. 4 and 5.
Figure 7:
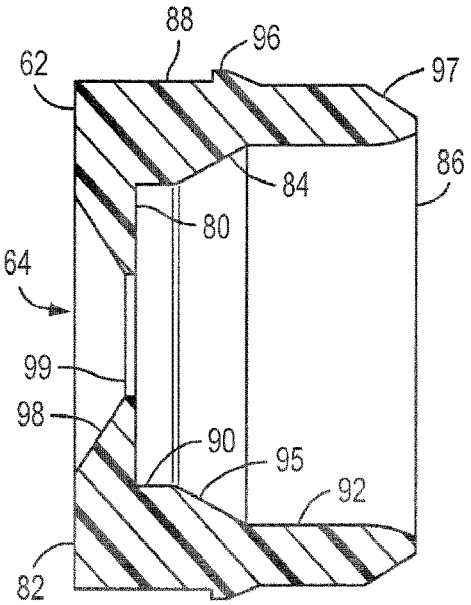
FIG. 7 is a cross-sectional view taken from line 7-7 in FIG. 6.
Figure 8:
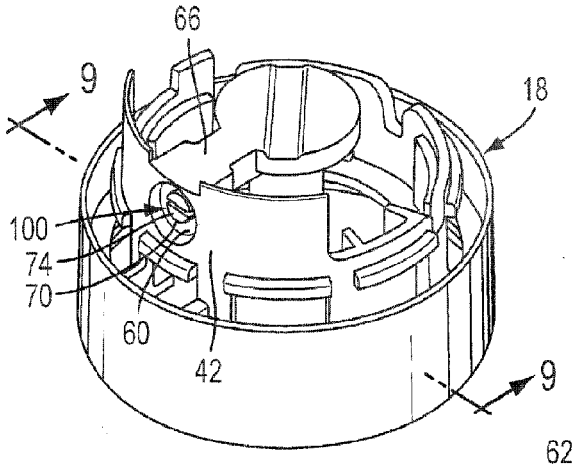
FIG. 8 is an isometric view from above and the front of an actuator housing including a post according to the invention.

As best seen in FIG. 1, the actuator 18 includes an actuator button 40 and an actuator housing 42. As best seen in FIGS. 2 and 3, the housing 42 includes a downwardly extending skirt or base 44 to secure the actuator 18 to the container 14. It should be appreciated that there are many possible forms for the housing 42 and the actuator button 40 and that in some instances, the actuator button 40 may include the downwardly extending skirt or base 44 and the housing 42 not. As best seen in FIG. 3, the housing 42 preferably includes a stem pocket 56 to receive the valve stem 30, and a flow path 58 to direct fluent product from the valve stem 30 and the stem pocket 56 to an exterior of the actuator 18. In this regard, in the illustrated embodiment, the flow path 58 extends to an exit port 60, which in the illustrated embodiment has an annular configuration into which can be press-fit a mechanical breakup unit (MBU) or spray insert 62 having an exit orifice 64. The housing 42 also preferably includes a cantilevered arm 66 with the stem pocket 56 and flow path 58 defined therein, as best seen in FIGS. 6-8. The arm 66 is movable between a neutral position (FIG. 3) wherein the stem pocket 56 is located so as not to actuate the valve 16 and an actuating position wherein the stem pocket 56 is located to actuate the valve 16 to dispense a fluent product. The arm 66 is biased to the neutral position, which in the illustrated embodiment is the as-molded condition or as-formed condition of the housing 42 including the arm 66. Some examples of acceptable actuator constructions are shown in Published Application 2008/20210710 A1, U.S. Pat. Nos. 7,249,692; 7,861,894, and international application Ser. No. PCT/US11/47440. It should be understood that, except as further described below, the details of the actuator 18 are not crucial to the invention herein.

As seen in FIG. 3, in the illustrated embodiment, a post 70 is located within the exit port 60 extending along and centered on a longitudinal axis 72. The post 70 has an end face 74 extending transverse to the longitudinal axis 72 adjacent the exit orifice 64. The post 70 is further defined by a laterally outwardly facing side wall surface 76 that is cylindrical in shape in the illustrated embodiment. The spray insert 62 is received in an annular gap 78 defined between the side wall surface 76 and a laterally inwardly facing cylindrical wall surface 79 of the exit port 60, with the insert 62 having an interference fit with the surface 79 to retain the insert 62 within the exit port 60.

Figure 10:
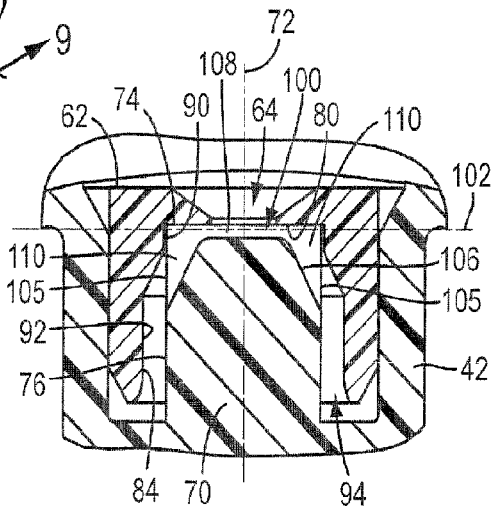
FIG. 10 is a fragmentary, cross-sectional view taken from line 10-10 in FIG. 9 and showing a spray insert component assembled into the actuator housing.
Figure 11:
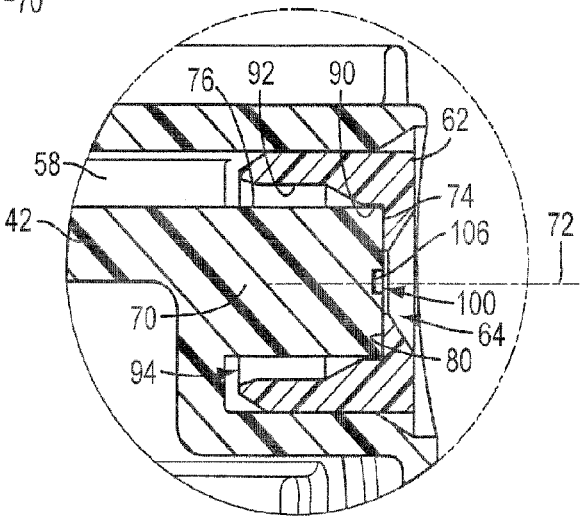
FIG. 11 is a fragmentary view taken from line 11-11 in FIG. 9 and again showing the installed spray insert.
Figure 12:
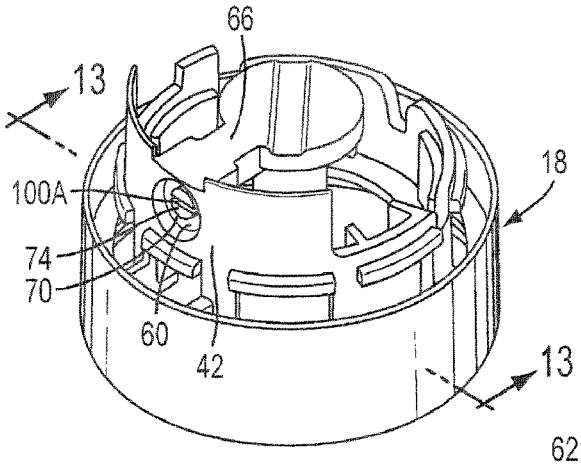
FIG. 12 is an isometric view from above and the front of an actuator housing including another post according to the invention.

As best seen in FIGS. 3-7, the spray insert 62 has an interior face 80 overlying the end face 74 of the post 70, an exterior face 82 opposite from the interior face 80, with the exit orifice 64 extending from the interior face 80 to the exterior face 82, a laterally inwardly facing wall surface 84 extending from the interior face 80 to an open end 86 of the insert 62, and a laterally outwardly facing wall surface 88 extending from the open end 86 to the exterior face 82. As best seen in FIGS. 10 and 11, in the installed state, the wall surface 84 surrounds at least a portion of the post 70 to define a portion of the flow path 58 between the wall surface 84 and the sidewall surface 76 of the post 70. In this regard, the wall surface 84 preferably includes a axial portion 90 that closely conforms to the side wall surface 76 of the post 70 adjacent the interior face 80 of the insert 62, and an axial portion 92 that is laterally spaced from the side wall surface 76 of the post 70 to define an annular flow space 94 between the surfaces 84 and 76. A frustoconical portion 95 of the wall surface 84 extends between the axial portions 90 and 92. The laterally outwardly facing wall surface 88 preferably has an interference fit with the wall surface 79 of the exit port 60 and preferably includes a wedge shaped, annular rib or barb 96 (FIGS. 4-7) that helps to further retain the insert 62 in the exit port 60. An annular chamfer 97 is preferably provided on the wall surface 88 adjacent the open end 86 to assist in assembling the insert 62 into the exit port 60.

Figure 4:
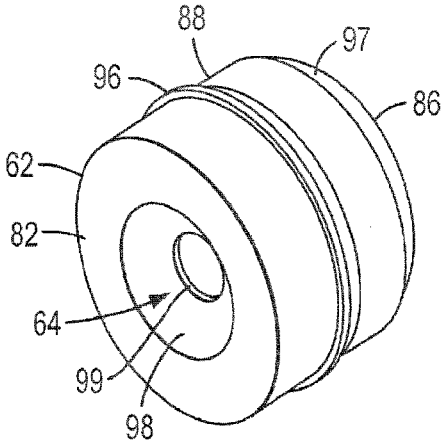
FIG. 4 is an isometric view from the front of a spray insert for use in the actuator.
Figure 5:
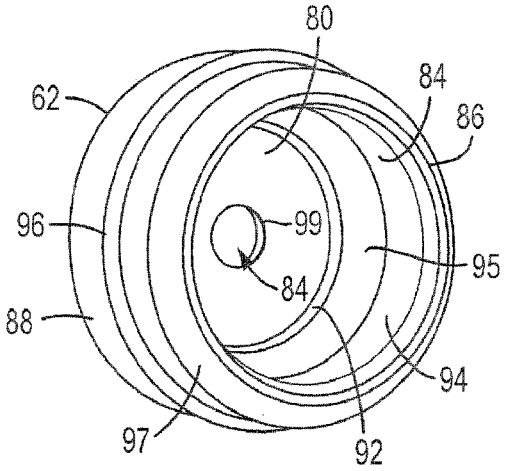
FIG. 5 is an isometric view from behind of the insert of FIG. 4.

As best seen in FIGS. 4 and 7, in the illustrated embodiment, the exit orifice 64 has a frustoconical exit portion 98 that diverges as it extends toward the exterior face 82 of the spray insert 62. Furthermore, in the illustrated embodiment, the exit orifice 64 includes a cylindrically-shaped inlet portion or land 99 that extends from the interior face 80 to the frustoconical exit portion 98. As best seen in FIGS. 10 and 11, the orifice 64 is centered on the longitudinal axis 72.

Figure 9:
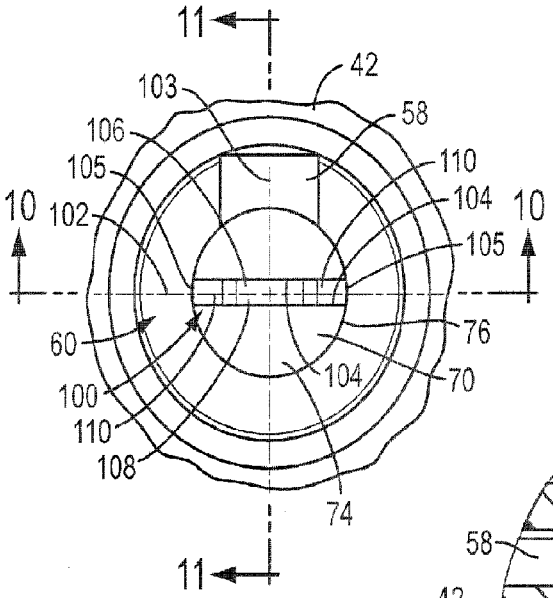
FIG. 9 is an enlarged, fragmentary view taken from line 9-9 in FIG. 8.

As best seen in FIG. 9, a flow channel 100 extends laterally across the end face 74 of the post 70 and is symmetric about a lateral axis 102 extending transverse to the longitudinal axis 72 of the post 70. Furthermore, in the illustrated embodiment, the flow channel 100 is also symmetric about a transverse axis 103 extending transverse to the longitudinal axis 72 and the lateral axis 102. As best seen in FIGS. 3, 10 and 11, a portion of the flow channel 100 underlies the exit orifice 64 and directly communicates with the exit orifice 64 to direct the fluent product from the flow channel 100 into the exit orifice 64.

The flow channel 100 is defined by two spaced side surface 104, with the spacing of each side surface 104 from the lateral axis 102 being equal to the spacing of the other side surface 104 from the lateral axis 102 as each side surface 104 extends laterally across the end face 74 of the post 70 and opens to the laterally outwardly facing side surface 76 on opposite sides 105 of the post 70. In the embodiment illustrated in FIGS. 8-10, the side surfaces 104 extend parallel to each other and to the lateral axis 102 over the entire lateral length of the surfaces 104. The flow channel 100 is further defined by a bottom surface 106 extending from one of the side surfaces 104 to the other of the side surfaces 104, with the bottom surface 106 defining a flow channel depth relative to the end face 74, as best seen in FIG. 10. In the illustrated embodiment, the depth of the flow channel 100 relative to the end face 74 varies as the flow channel 100 extends laterally across the end face 74. More specifically, again as best seen in FIG. 10, the depth of the flow channel 100 remains constant over a central portion 108 of the channel 100 and then increases in depth over opposite end portions 110 of the channel 100 as the bottom surface 106 extends laterally outwardly from the central portion 108 to the opposite sides 105 of the post 70. As best seen in FIGS. 8, 10, and 11, in the illustrated embodiment, the bottom surface 106 in the central portion 108 is planar, extends parallel to the lateral axis 102 and defines a plane transverse to the longitudinal axis 72, while the bottom surface 106 in each of the end portions 110 is planar and extends at an angle relative to the axes 72 and 102.

In the assembled state, the interior face 80 of the insert 62 preferably abuts the end face 74 of the post 70, as best seen in FIGS. 3, 10 and 11, with the axial portion 90 closely conforming to the laterally outwardly facing side wall surface 76 of the post 70. This serves to direct the fluent product into the flow channel 100 as it flows through the flow path 58 from the valve stem 30 to the exit orifice 64. In this regard, the increased depth of each of the end portions 110 provides a large flow area in the flow path 58 as it transitions from the annular flow space 94 to the flow channel 100 at each side 105 of the post 70, as best seen in FIG. 10. The fluent product enters the flow channel 100 at the opposite sides 105 of the post 70 and meets at the central portion 108 to exit the orifice 64. The inventors have discovered that this unique flow regime produces a fan spray pattern of the fluent product from the actuator 18. Furthermore, the inventors have discovered that different fan spray pattern shapes can be achieved with different shapes and/or sizes of the flow channel 100. More specifically, it has been discovered that different shapes for the side surfaces 104 and/or the bottom surface 106 will produce different fan spray pattern shapes. To that end, the present application describes below examples of alternate shapes for the flow channel 100 that will each produce a different fan spray pattern shape and those skilled in the art should appreciate that these examples are representative of the many possible alternate shapes and are not intended to be exhaustive of all the possible shapes for the flow channel 100 according to the invention.

In the following examples of alternate shapes for the flow channel 100, it should be understood that like numbers indicate like features and that differences between the previously described features and those of the following examples will be highlighted in the description of the alternate shapes and/or evident from the drawings.

Figure 14:
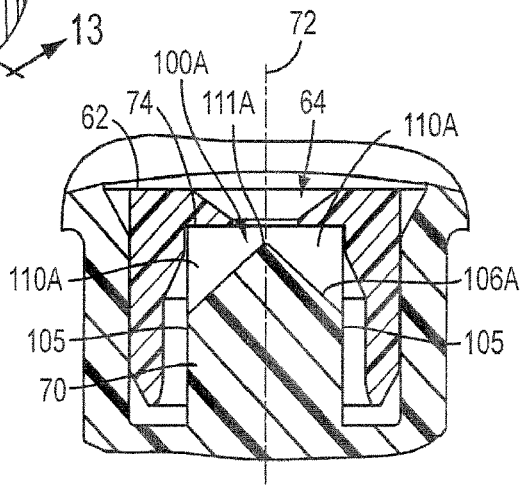
FIG. 14 is a fragmentary, cross-sectional view taken from line 14-14 in FIG. 13 and showing the spray insert assembled into the actuator housing.
Figure 13:
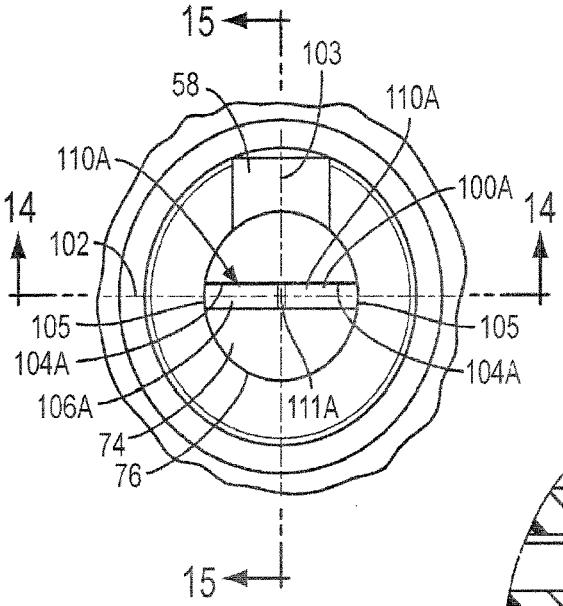
FIG. 13 is an enlarged, fragmentary view taken from line 13-13 in FIG. 12.
Figure 15:
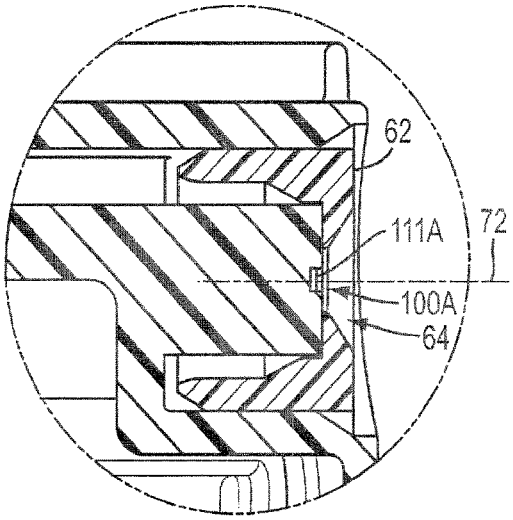
FIG. 15 is a fragmentary view taken from line 15-15 in FIG. 13 and again showing the installed spray insert.
Figure 16:
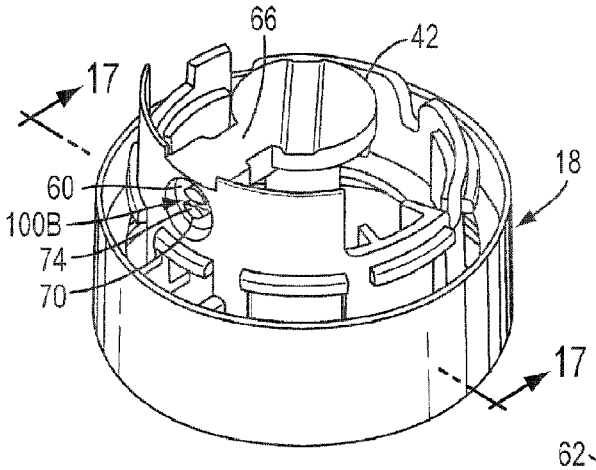
FIG. 16 is an isometric view from above and the front of an actuator housing including another post according to the invention.

FIGS. 12-15 show an alternate flow channel 100A having a bottom surface 106A that differs from the bottom surface 106 of the flow channel 100 shown in FIGS. 8-11. Specifically, as shown in FIG. 14, the bottom surface 106A defines a v-shaped profile where the bottom surface 106A intersects planes that are parallel to both the longitudinal axis 72 and the lateral axis 102. In this regard, the flow channel 100A has end portions 110A that extend from the opposite sides 105 of the post 70 to an apex 111A of the bottom surface 106A at the intersection of the bottom surface 106A with the longitudinal axis 72.

Figure 18:
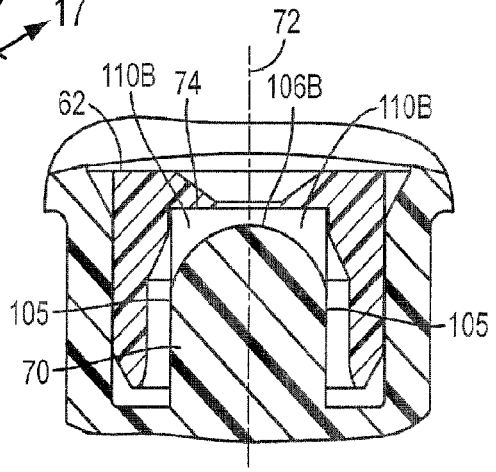
FIG. 18 is a fragmentary, cross-sectional view taken from line 18-18 in FIG. 17 and showing the spray insert assembled into the actuator housing.
Figure 17:
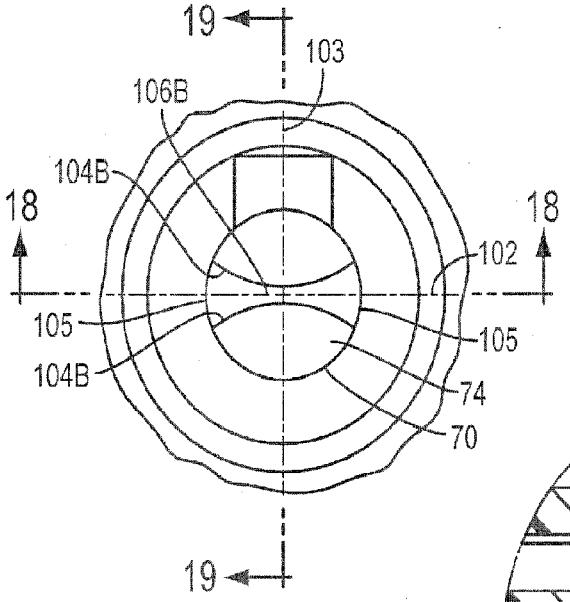
FIG. 17 is an enlarged, fragmentary view taken from line 17-17 in FIG. 16.
Figure 19:
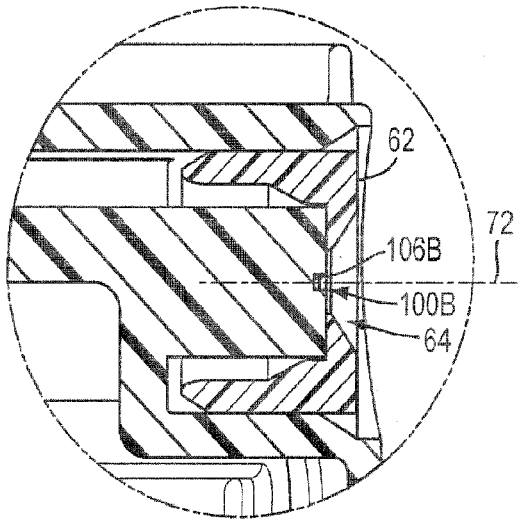
FIG. 19 is a fragmentary view taken from line 19-19 in FIG. 17 and again showing the installed spray insert.
Figure 20:
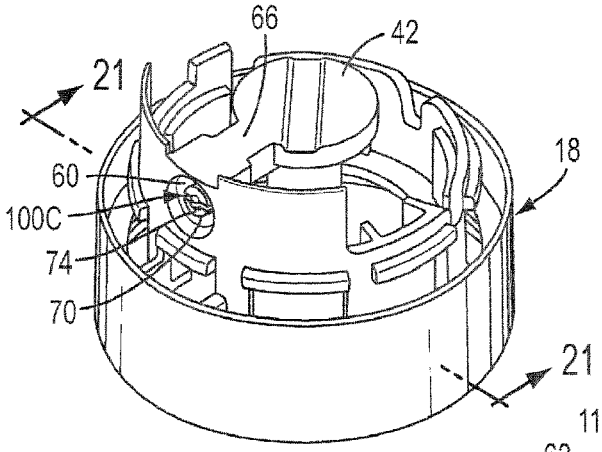
FIG. 20 is an isometric view from above and the front of an actuator housing including another post according to the invention.

FIGS. 16-19 show an alternate flow channel 100B having side surfaces 104B and a bottom surface 106B that differ from the side surfaces 104 and the bottom surface 106 of the flow channel 100 shown in FIGS. 8-11. Specifically, as shown in FIG. 17, the side surfaces 104B have an arcuate shape where the side surfaces 104B intersect planes that are transverse to the longitudinal axis 72, with the spacing between varies across the face 74 of the post 70 by getting larger as each of the side surfaces 104B extend laterally outwardly to the opposite sides 105 of the post 70. As best seen in FIG. 18, the bottom surface 106E has an arcuate shape that defines an arcuate shaped profile where the bottom surface 106B intersects planes extending parallel to both the longitudinal axis 72 and the lateral axis 102. This provides the flow channel 100B with end portions 1108 that extend from the opposite sides 105 of the post 70 to the intersection of the bottom surface 106B with the longitudinal axis 72.

Figure 22:
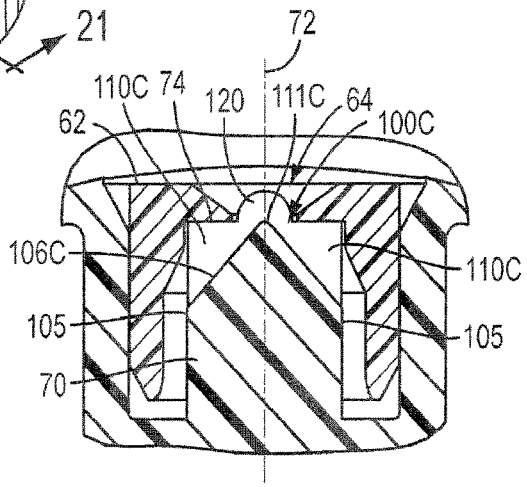
FIG. 22 is a fragmentary, cross-sectional view taken from line 22-22 in FIG. 21 and showing the spray insert assembled into the actuator housing.
Figure 21:
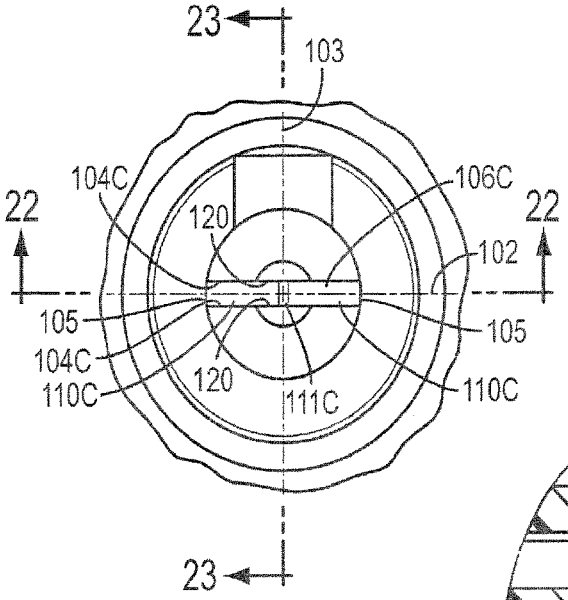
FIG. 21 is an enlarged, fragmentary view taken from line 21-21 in FIG. 20.
Figure 23:
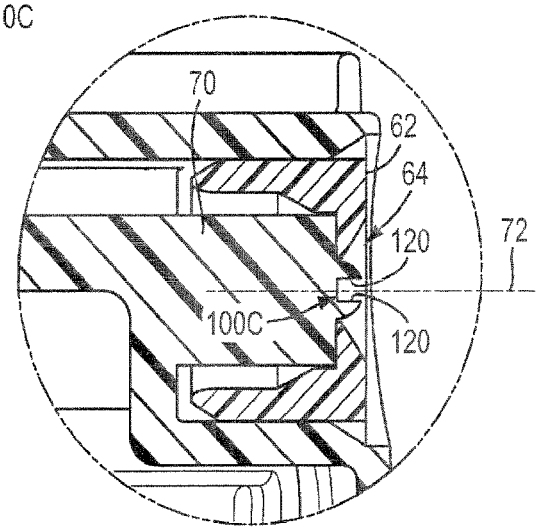
FIG. 23 is a fragmentary view taken from line 23-23 in FIG. 21 and again showing the installed spray insert.
Figure 24:
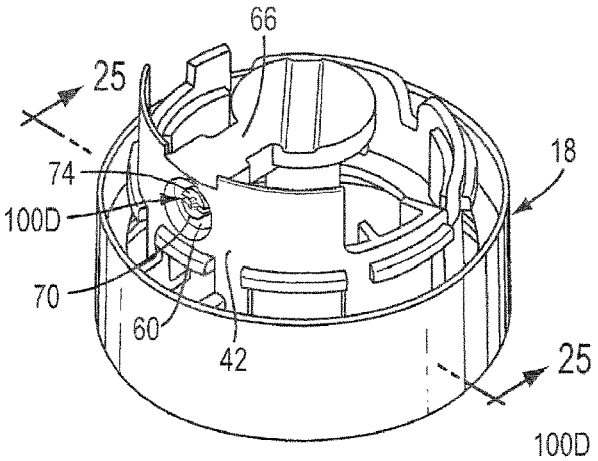
FIG. 24 is an isometric view from above and the front of an actuator housing including another post according to the invention.

FIGS. 20-23 show an alternate flow channel 100C having side surfaces 104C and a bottom surface 106C that differ from the side surfaces 104 and the bottom surface 106 of the flow channel 100 shown in FIGS. 8-11. Specifically, as best seen in FIGS. 22 and 23, each of the side surfaces 104C has an extension portion 120 that extends longitudinally outwardly into the exit orifice 64. As shown in FIG. 22, the bottom surface 106C defines a v-shaped profile where the bottom surface 106C intersects planes that are parallel to both the longitudinal axis 72 and the lateral axis 102. In this regard, the flow channel 100C has end portions 110C that extend from the opposite sides 105 of the post 70 to an apex 111C of the bottom surface 106C at the intersection of the bottom surface 106C with the longitudinal axis 72.

Figure 26:
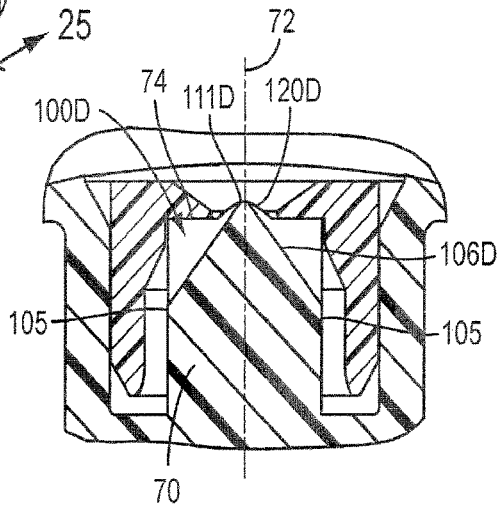
FIG. 26 is a fragmentary, cross-sectional view taken from line 26-26 in FIG. 25 and showing the spray insert assembled into the actuator housing.
Figure 25:
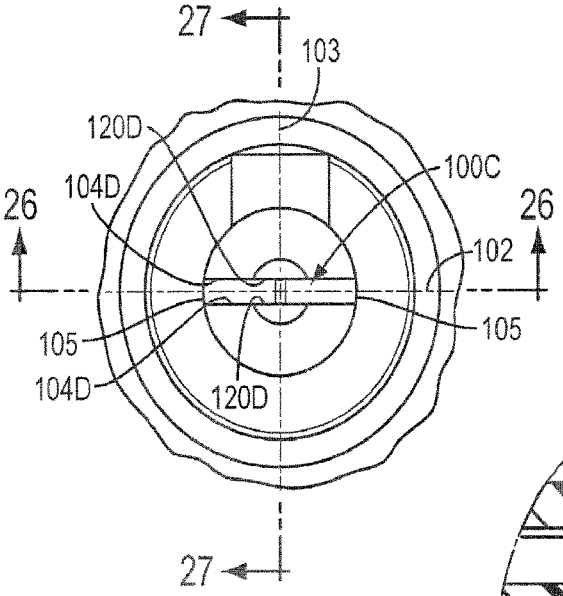
FIG. 25 is an enlarged, fragmentary view taken from line 25-25 in FIG. 24.
Figure 27:
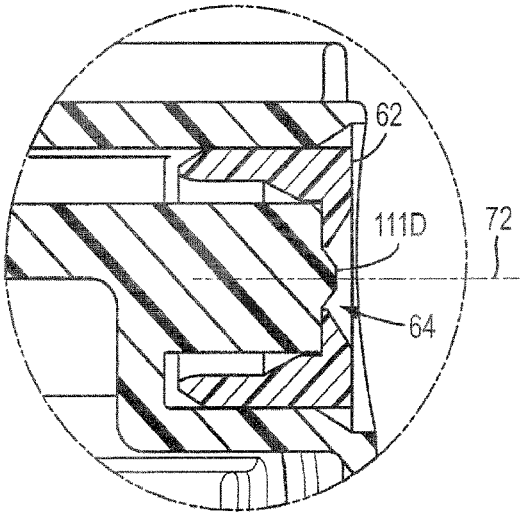
FIG. 27 is a fragmentary view taken from line 27-27 in FIG. 25 and again showing the installed spray insert.
Figure 28:
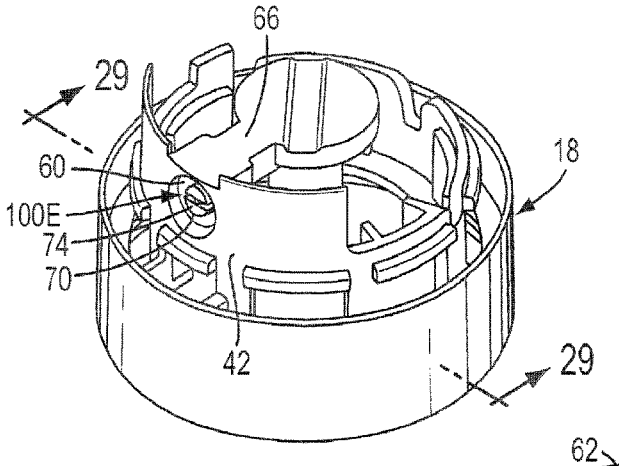
FIG. 28 is an isometric view from above and the front of an actuator housing including another post according to the invention.

FIGS. 24-27 show an alternate flow channel 100D having side surfaces 104D and a bottom surface 106D that are very similar to the side surfaces 104C and the bottom surface 106C of the flow channel 100C shown in FIGS. 20-23. They differ in that the apex 111D of bottom surface 106D extends longitudinally outwardly as far as the extension portions 120D of the side surfaces 104D, as best seen in FIG. 26, whereas the apex 111C of the bottom surface 106C of the flow channel 100C does not.

Figure 30:
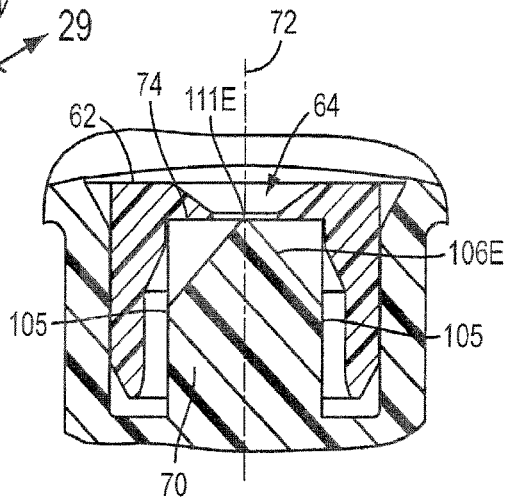
FIG. 30 is a fragmentary, cross-sectional view taken from line 30-30 in FIG. 29 and showing the spray insert assembled into the actuator housing.
Figure 29:
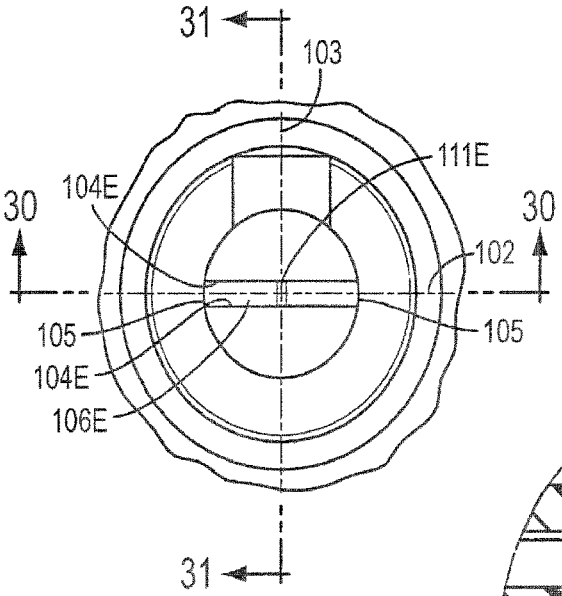
FIG. 29 is an enlarged, fragmentary view taken from line 29-29 in FIG. 28.
Figure 31:
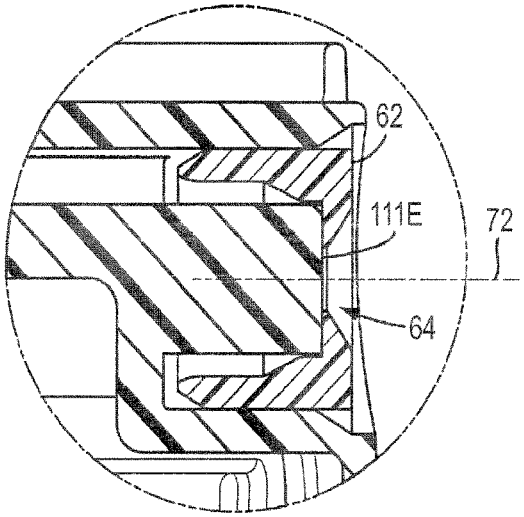
FIG. 31 is a fragmentary view taken from line 31-31 in FIG. 29 and again showing the installed spray insert.

FIGS. 28-31 show an alternate flow channel 100E having side surfaces 104E and a bottom surface 106E that are very similar to the side surfaces 104A and the bottom surface 106A of the flow channel 100A shown in FIGS. 12-15. They differ in that the apex 111E of bottom surface 106E extends longitudinally outwardly to the end face 74, as best seen in FIG. 30, whereas the apex 111A of the bottom surface 106A of the flow channel 100A does not.

Figure 32:
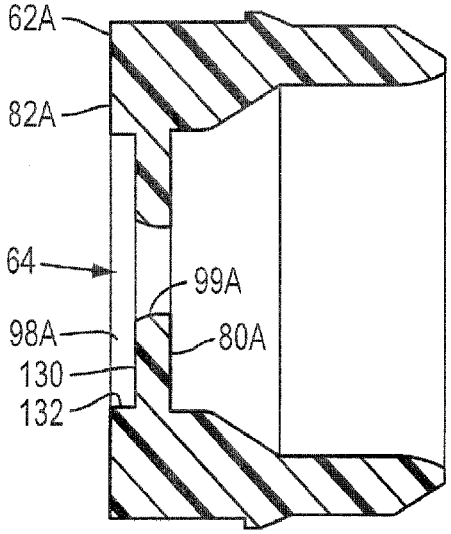
FIG. 32 is a cross-sectional view similar to FIG. 7, but showing another embodiment of a spray insert for use in the actuator.

The inventors have further discovered that different fan spray pattern shapes can be achieved with different shapes and/or sizes of the exit orifice 64. FIG. 32 shows one example of the many possible variations in this regard. Specifically, FIG. 32 shows a spray insert 62A having an exit orifice 64A having a smaller opening diameter than the exit orifice 64 of the spray insert 62, but having a land 99A that having a greater longitudinal length than the land 99 of the spray insert 62. Furthermore, the land 99A flares laterally outwardly in the flow direction of the fluent product through the orifice 64A, whereas the land 99 of the insert 62 does not. The exit portion 98A of the orifice 64A is a wall surface 130 that extends laterally from the land 99A to a laterally inwardly facing, cylindrical surface 132 that extends longitudinally to the exterior face 82A. It will be appreciated by those skilled in the art that there are many other possible variations that can be made to the exit orifices 64 and 64A within the scope of the invention.

It should be understood that while some preferred embodiments are shown, these embodiments are illustrative of the concepts of the invention and that there are many possible forms for the actuator 18, post 70, flow channels 100, spray insert 62, and exit orifice 64 that are within the scope of the invention. For example, the size of flow channel 100 and the exit orifice 64 can be modified from those illustrated to achieve different fan spray patterns and/or to accommodate different fluent products and/or different dispensing pressures. As a further example, while many of the features have annular or cylindrical geometries, other geometries may be desirable depending upon the particular requirements of each application. As yet a further example, while much of the flow path 58 extends transverse to a long axis of the container 14, any other orientation is possible within the scope of the invention and other orientations may be more desirable depending upon the requirements of each application. As an even further example, while the flow channels 100 and orifices 64 in the illustrated embodiments are shown centered on the longitudinal axis 72 of the post 70, it may be desirable in some applications for the flow channel 100 and/or orifice 64 to be offset relative to the longitudinal axis 72. Additionally, while the lateral axis 102 and the flow channels 100 are shown extending horizontally in the illustrated embodiments, in some applications it will be desirable for the lateral axis 102 and flow channels 100 to extend at other angles, such as, for example vertically, or as a further example, at a 45 degree angle relative to horizontal. Furthermore, while all of the illustrated embodiments show a single flow channel/exit orifice combination, it may be desirable to provide multiple such combinations in a single actuator 18. As yet a further example, while a specific form has been shown for the spray insert 62; other forms may be used to provide the appropriate location of the exit orifice 64 relative to the flow channel 100 while allowing the fluent product to be directed into the flow channel 100 from the upstream portion of the flow path 58. In view of the foregoing, no limitations should be read into the claims unless expressly recited therein.

It should be appreciated that by forming the flow channel into the post 70, the spray insert 62 can be assembled into the actuator 18 without the need for specific orientation of the spray insert 62 during assembly of the spray insert 62 into the actuator 18. Further, it should be appreciated that different configurations of the flow channel 100 can be provided in an actuator 18 by making relatively easy and cost effective modifications to the molding dies of the actuator 18.

What is claimed is:

1. In an actuator (18) for actuating a valve (16) on a container (14) for dispensing a fluent product from the container (14), the actuator (18) including a dispensing flow path (58) to direct fluent product from the valve (16) to an exterior of the actuator (18) via an exit orifice (64) located at an end of the flow path (58), and a post (70) defining a portion of the flow path (58), the post (70) extending along and centered on a longitudinal axis (72) and having an end face (74) adjacent said exit orifice (64), an improvement comprising:

a flow channel (100) extending laterally across the end face (74) of the post (70), the flow channel (100) being symmetric about a lateral axis (102) extending transverse to the longitudinal axis (72) of the post (70), a portion of the flow channel (100) directly communicating with said exit orifice (64) to direct the fluent product from the flow channel (100) into the exit orifice (64);

wherein the exit orifice (64) is symmetric about the lateral axis (102) of the post (70).

2. The improvement of claim 1 wherein the exit orifice (64) is defined in an insert (62) having an interior face (80) overlying the end face (74) of the post (70), an exterior face (82) opposite from the interior face (80) with the exit orifice (64) extending from the interior face (80) to the exterior face (82), and a laterally inwardly facing wall surface (84) extending from the interior face (80) and surrounding at least a portion of the post (70) to define a portion of the flow path (58) between the wall surface (84) and a laterally outwardly facing side wall surface (76) of the post (70).

3. The improvement of claim 2 wherein the exit orifice (64) comprises a frustoconical exit portion (98) that diverges as it extends towards the exterior face (82) of the insert (62).

4. The improvement of claim 2 wherein the orifice (64) is centered on the longitudinal axis (72) of the post (70), and the lateral axis (102) of the flow channel (100) intersects the longitudinal axis (72) of the post (70).

5. The improvement of claim 1 wherein the flow channel (100) is defined by two spaced side surfaces (104), the spacing of each side surface (104) from the lateral axis (102) being equal to the spacing of the other side surface (104) from the lateral axis (102) as each side surface (104) extends laterally across the end face (74) of the post (70).

6. The improvement of claim 5 wherein the side surfaces (104) extend parallel to each other and to the lateral axis (102).

7. The improvement of claim 5 wherein the spacing between the side surfaces (104) varies across the face (74) of the post (70).

8. The improvement of claim 5 wherein the lateral axis (102) of the flow channel (100) intersects the longitudinal axis (72) of the post (70), and the side surfaces (104) are spaced farther from each other as they extend laterally outward from the longitudinal axis (72).

9. The improvement of claim 5 wherein the flow channel (100) is symmetric about a transverse axis (103) that intersects the longitudinal axis (72) of the post (70) and extends transverse to both the longitudinal axis (72) and the lateral axis (102).

10. The improvement of claim 5 wherein portions of the side surfaces (104) extend into the exit orifice (64).

11. The improvement of claim 5 wherein the flow channel (100) is further defined by a bottom surface (106) extending from one of the side surfaces (104) to the other of the side surfaces (104), the bottom surface (106) defining a flow channel depth relative to the end face (74) that varies as the flow channel (100) extends laterally across the end face (74).

12. The improvement of claim 11 wherein the bottom surface (106) defines an arcuate shaped profile at an intersection of the bottom surface (106) with a plane extending parallel to both the longitudinal axis (72) and the lateral axis (102).

13. The improvement of claim 11 wherein the bottom surface (106) defines a v-shaped profile at an intersection of the bottom surface (106) with a plane extending parallel to both the longitudinal axis (72) and the lateral axis (102).

14. The improvement of claim 11 wherein a central portion (108) of the bottom surface (106) is planar and extends parallel to the lateral axis (102) and defines a plane transverse to the longitudinal axis (72).

15. The improvement of claim 11 wherein the post (70) is defined by a cylindrical, laterally outwardly facing, side wall surface (76) that is centered on the longitudinal axis (72) and extends from the end face (74) to a remainder of the actuator (18), and the end face (74) is planar and extends transverse to the longitudinal axis (72).

16. In an actuator (18) for actuating a valve (16) on a container (14) for dispensing a fluent product from the container (14), the actuator (18) including a dispensing flow path (58) to direct fluent product from the valve (16) to an exterior of the actuator (18) via an exit orifice (64) located at an end of the flow path (58), and a post (70) defining a portion of the flow path (58), the post (70) extending along and centered on a longitudinal axis (72) and having an end face (74) adjacent said exit orifice (64), an improvement comprising:

only a single flow channel (100) extending laterally across the end face (74) of the post (70), the flow channel (100) being symmetric about a lateral axis (102) extending transverse to the longitudinal axis (72) of the post (70), a portion of the flow channel (100) directly communicating with said exit orifice (64) to direct the fluent product from the flow channel (100) into the exit orifice (64).

17. In an actuator (18) for actuating a valve (16) on a container (14) for dispensing a fluent product from the container (14), the actuator (18) including a dispensing flow path (58) to direct fluent product from the valve (16) to an exterior of the actuator (18) via an exit orifice (64) located at an end of the flow path (58), and a post (70) defining a portion of the flow path (58), the post (70) extending along and centered on a longitudinal axis (72) and having an end face (74) adjacent said exit orifice (64), an improvement comprising:

a flow channel (100) extending laterally fully across the end face (74) of the post (70), the flow channel (100) being symmetric about a lateral axis (102) extending transverse to the longitudinal axis (72) of the post (70), a portion of the flow channel (100) directly communicating with said exit orifice (64) to direct the fluent product from the flow channel (100) into the exit orifice (64).

* * * * *